US006230597B1

(12) United States Patent
Baba et al.

(10) Patent No.: US 6,230,597 B1
(45) Date of Patent: May 15, 2001

(54) ROTARY DIE CUTTER

(75) Inventors: Yasuyuki Baba; Kunio Niuchi, both of Mihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/271,142

(22) Filed: Mar. 17, 1999

(30) Foreign Application Priority Data

Mar. 17, 1998 (JP) ..... 10-066505
Mar. 17, 1998 (JP) ..... 10-066506

(51) Int. Cl.[7] ..... B26D 7/08
(52) U.S. Cl. ..... 83/171; 83/343
(58) Field of Search ..... 83/170, 171, 343

(56) References Cited

U.S. PATENT DOCUMENTS 1,036,173 * 8/1912 Arey ..... 83/170 X
3,064,563 * 11/1962 Cook ..... 83/171 X
3,156,274 * 11/1964 Golick ..... 83/170
3,186,275 * 6/1965 Obenshain ..... 83/170
3,196,487 * 7/1965 Snelling ..... 83/170 X
3,355,974 * 12/1967 Carmichael ..... 83/171
3,750,503 * 8/1973 McMillan ..... 83/171 X
4,402,559 * 9/1983 Shibata et al. ..... 308/189 R
4,948,269 * 8/1990 Hamilton ..... 83/170 X
5,022,295 * 6/1991 Stemmler ..... 83/171 X
5,366,814 * 11/1994 Irikura ..... 83/171 X
5,582,237 * 12/1996 Miyano ..... 83/170 X

* cited by examiner

*Primary Examiner*—Charles Goodman
(74) *Attorney, Agent, or Firm*—Alston & Bird LLP

(57) ABSTRACT

A rotary die cutter in accordance with the present invention has frames 1 for rotatably supporting a die cut cylinder 20 and an anvil cylinder 21 via a bearing 22, and is configured so that oil is circulated in the die cut cylinder 20 and/or the anvil cylinder 21. Also, another rotary die cutter in accordance with the present invention has frames 20 for rotatably supporting a die cut cylinder 3 and an anvil cylinder 4 via a bearing 21, and is configured so that a cooled lubricating oil 23 is supplied to the bearing 21.

6 Claims, 6 Drawing Sheets

ROTARY DIE CUTTER

BACKGROUND OF THE INVENTION

The present invention relates to a rotary die cutter for blanking corrugated fiberboard sheets or the like.

As a rotary die cutter of this type, a cutter, for example, shown in FIGS. 4 to 6 has been publicly known. In this cutter shown in FIG. 4, frames 1 are erected on both sides, right and left, and a die cut cylinder 3 and an anvil cylinder 4 are rotatably supported on these frames 1 via bearings 5.

The die cut cylinder 3 has a cylindrical outer peripheral surface, and at opposite ends thereof are provided support shafts 3*a* coaxially. Each of the support shafts 3*a* is rotatably supported on the frame 1 via the bearing 5. Similarly, the anvil cylinder 4 also has a cylindrical outer peripheral surface, and at opposite ends thereof are provided support shafts 4*a* coaxially. Each of the support shafts 4*a* is rotatably supported on the frame 1 via the bearing 5.

At a portion where each support shaft 3*a* protrudes from the frame 1, a gear 6 is provided to cause the die cut cylinder 3 to rotate. Also, at a portion where each support shaft 4*a* protrudes from the frame 1, a gear 7 is provided to cause the anvil cylinder 4 to rotate. These gears 6 and 7 mesh with each other.

Each frame 1 is provided with a side cover 8 for covering the gears 6 and 7. This side cover 8 is constructed such that a portion under the gears 6 and 7 (a portion under the bearings 5) forms an oil reservoir 8*a* for storing a lubricating oil. The lubricating oil stored in the oil reservoir 8*a* adheres to a gear 10 supported rotatably on the frame 1, and further adheres to the gear 7 meshing with the gear 10, so that the gears 7 and 6 are lubricated. The bearing 5 is lubricated by grease loaded inside.

As shown in FIG. 6, a blanking section itself is constructed so that the rotation is transmitted from, for example, a printing unit (not shown) on the upstream side by a connection gear 13 meshing with the gear 6, and is further transmitted to a unit (not shown) on the downstream side by a connection gear 14 meshing with the gear 6.

As shown in FIGS. 4 and 5, a blanking die 11 is installed on the die cut cylinder 3, and this blanking die 11 is provided with knives 11*a*. The knife 11*a* performs blanking of a corrugated fiberboard sheet 12 by holding the corrugated fiberboard sheet 12 between the knife 11*a* and the surface of the anvil cylinder 4.

The rotary die cutters come in two types: a cutting type called soft cut in which a sawtooth knife is used as the knife 11*a* and a rubber anvil is used as the anvil cylinder 4, and a cutting type called hard cut in which a straight tooth knife is used as the knife 11*a* and a metal anvil is used as the anvil cylinder 4.

In the case of the latter hard cut, since cutting is performed by pressing the hard knife 11*a* on the hard anvil cylinder 4, the pressing amount, in other words, a center distance between the die cut cylinder 3 and the anvil cylinder 4 is required to be maintained precisely (usually, an accuracy in the order of 1/100 mm is strictly kept). If such a center distance cannot be kept, an uncut portion remains on the corrugated fiberboard sheet 12, or the blade edge of the knife 11*a* is collapsed by an excessive pressure.

In the above-described rotary die cutter, the bearings 5 are heated by the rotation of the die cut cylinder 3 and the anvil cylinder 4, and part of this heat is transmitted to the frames 1, so that the temperature of the frames 1 rises. Therefore, the frame 1 is elongated by thermal expansion, resulting in an increase in the distance between the support shafts 3*a* and 4*a* of the die cut cylinder 3 and the anvil cylinder 4.

For this reason, a cutting pressure of the knife 11*a* acting on the anvil cylinder 4 decreases, or sometimes a gap is produced between the knife 11*a* and the anvil cylinder 4, which leads to a possibility that improper cutting occurs. To overcome this problem, with the elapse of time, it is necessary to adjust the aforesaid distance between the support shafts 3*a* and 4*a*, or to adjust the blanking die 11, which causes the hindrance to productivity.

Also, part of the aforesaid heat is transmitted to the die cut cylinder 3 and the anvil cylinder 4 via the support shafts 3*a* and 4*a*, respectively, by which the temperature of the cylinders 3 and 4 are also increased. At this time, after the support shafts 3*a* and 4*a* first becomes hot, the heat conducts gradually from both the ends toward the central portion of the cylinders 3 and 4. That is to say, in each cylinder 3, 4, a temperature gradient is created from both the ends to the central portion. Thus, as indicated by the dashed line in FIG. 4, each cylinder 3, 4 is thermally deformed into a concave form. In this case, a gap between the knife 11*a* and the anvil cylinder 4 is narrow at portions at both ends of each cylinder 3, 4, and a gap between the knife 11*a* and the anvil cylinder 4 is wide at the central portion thereof, so that the cutting conditions becomes nonuniform in the width direction.

Further, since the amount of temperature rises of the frames 1 and the cylinders 3 and 4 are not equal, there is a difference between the change amount of center distance between the cylinders 3 and 4 caused by the thermal expansion of the frames 1 and the change amount (average amount in the width direction) of outside diameter of each cylinder 3, 4 caused by the thermal expansion of each cylinder 3, 4 itself. Therefore, with the elapse of operation time, the pressing pressure (average pressure in the width direction) of the knife 11*a* on the anvil cylinder 4 changes undesirably, which also makes the cutting conditions nonuniform.

SUMMARY OF THE INVENTION

The present invention has been made in view of the above situation, and an object thereof is to provide a rotary die cutter which can keep a steady cutting state even if the rotary die cutter is operated for a long period of time.

Invention of a first group

To achieve the above object, the invention of a first group provides a rotary die cutter having frames for rotatably supporting a die cut cylinder and an anvil cylinder via a bearing, characterized in that oil is circulated in the die cut cylinder and/or the anvil cylinder.

Thereupon, the heat which is generated at each bearing and heats the opposite end portions of each cylinder can be distributed to the whole of each cylinder. Therefore, the temperature difference in the width direction (axial direction) of the cylinder can be reduced, so that the temperature of the cylinder can be made substantially uniform. As a result, the cylinder can be prevented from being warped into a concave form, so tat a steady cutting state can be maintained even if the machine is operated for a long period of time.

Also, in the invention of the first group, a lubricating oil for a gear for driving they cylinder is used as the oil, and the lubricating oil can be scattered by the gear and splashed on the frame.

By this configuration, the temperature of the frame becomes almost the same as the temperature of the cylinder. Therefore, a difference between the change amount of center distance between the die cut cylinder and the anvil cylinder caused by the thermal expansion of frames and the thermal expansion amount of each cylinder can be decreased. Specifically, even if the center distance between the cylinders is changed by the temperature of lubricating oil, the dimension between the cylinders can be maintained precisely so that good cutting (blanking) work can be done. In other words, a steadier cutting state can be maintained even if the machine is operated for a long period of time.

Invention of a second group

To achieve the above object, the invention of a second group provides a rotary die cutter having frames for rotatably supporting a plurality of opposingly disposed cylinders, such as a die cut cylinder and an anvil cylinder, via a bearing, characterized in that a cooled lubricating oil is supplied to the bearing.

Thereby, a rise in temperature of the frame caused by the heat generated at the bearing can be kept within a predetermined temperature. In other words, the temperature of the frame can be kept constant. Since the center distance between the die cut cylinder and the anvil cylinder can be kept constant for a long period of time, a steady cutting state can be maintained even if the machine is operated for a long period of time.

Also, in the invention of the second group, the cooled lubricating oil can also be supplied to the frames.

By this configuration, the frames can also be cooled by the lubricating oil. Specifically, a rise in temperature of the frame caused by the heat generated at the bearing can be kept within a predetermined temperature at both of the bearing and the frame. Thus, an effect of keeping the center distance between the die cut cylinder and the anvil cylinder constant for a long period of time is further increased, so that a steadier cutting state can be maintained even if the machine is operated for a long period of time.

Further, in the invention of the second group, the configuration can be such that an oil reservoir is provided under the bearing, the lubricating oil stored in the oil reservoir is cooled, and the cooled lubricating oil is supplied to the frame by splashing via a gear for driving the cylinders.

By this configuration, the whole of the frame can be cooled fully. Thus, an effect of keeping the center distance between the die cut cylinder and the anvil cylinder constant for a long period of time is further increased, so that a steadier cutting state can be maintained even if the machine is operated for a long period of time.

Further, in the invention of the second group, the rotary die cutter can have a pump for supplying the cooled lubricating oil to the frame, a temperature sensor for detecting the temperature of the frame, and a controller for controlling the operation of the pump so as to control the temperature of the frame to a predetermined target temperature via the temperature sensor.

By this configuration, the temperature of the frame can be kept more constant. Thus, an effect of keeping the center distance between the die cut cylinder and the anvil cylinder constant for a long period of time is further increased, so that a steadier cutting state can be maintained even if the machine is operated for a long period of time.

DETAILED DESCRIPTION OF THE PREFERRED EMBODIMENTS

Invention of a first group

Figure 1:
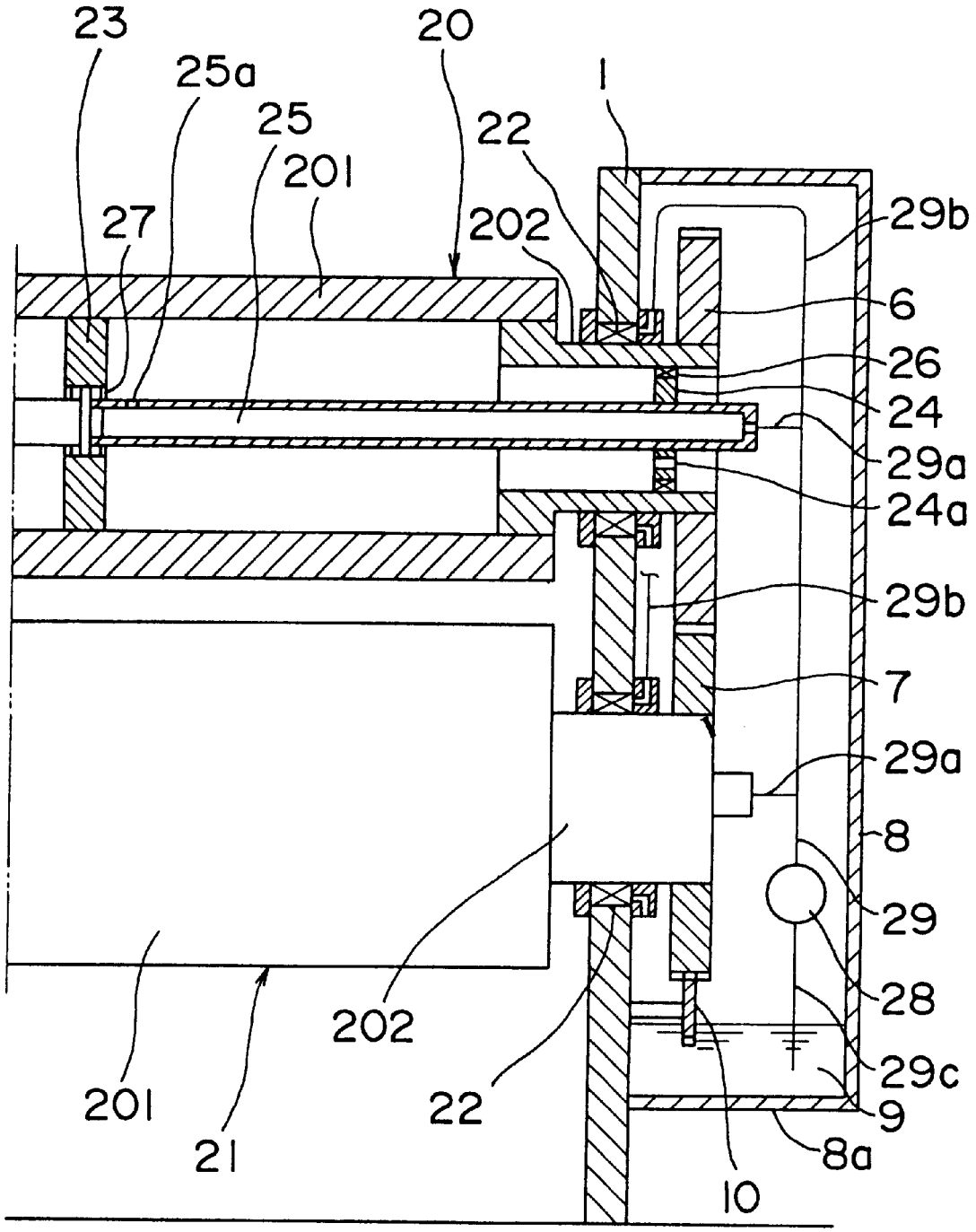
FIG. 1 is a sectional view of a principal portion of a blanking section for a rotary die cutter of one embodiment of the invention of a first group.
Figure 4:
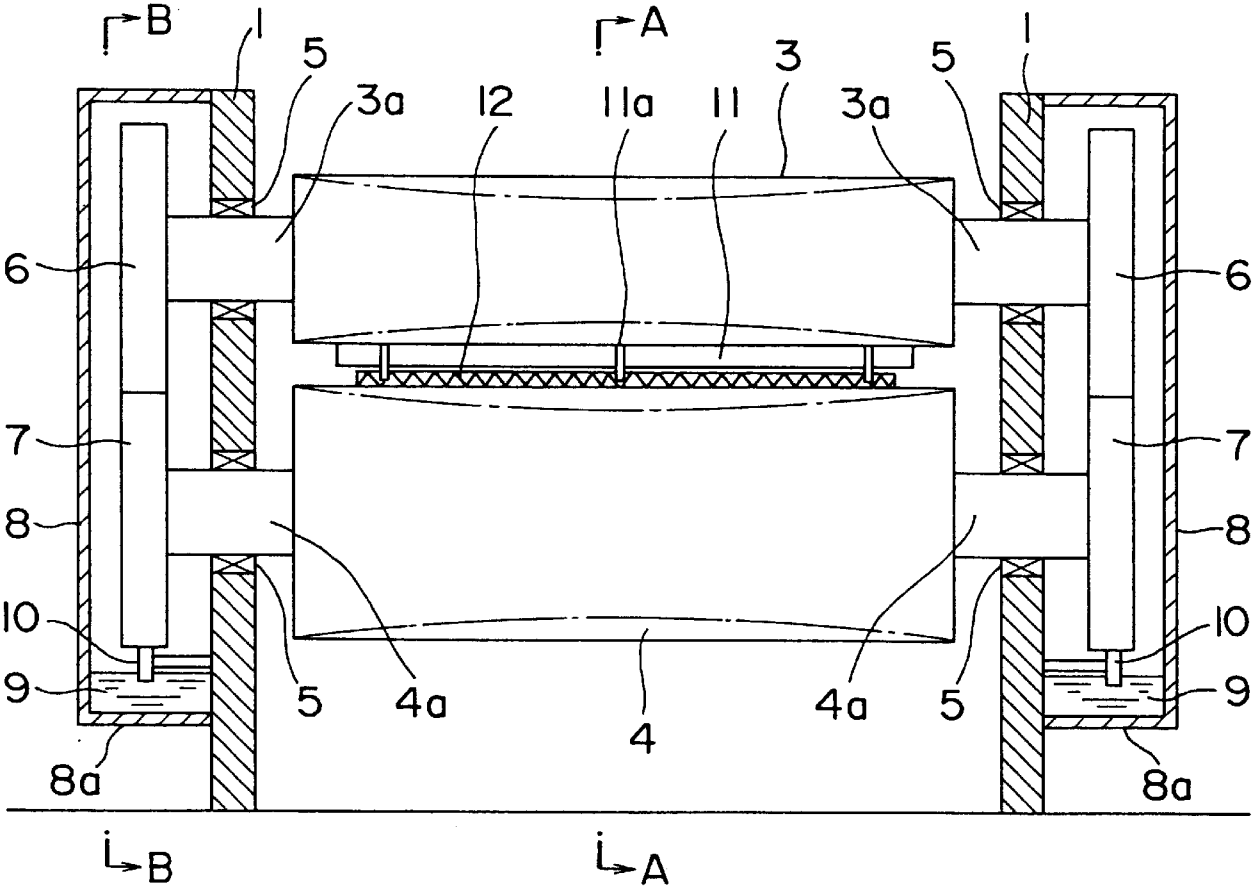
FIG. 4 (PRIOR ART)
FIG. 4 is a partially sectional view showing a construction of a blanking section of a conventional rotary die cutter.
Figure 5:
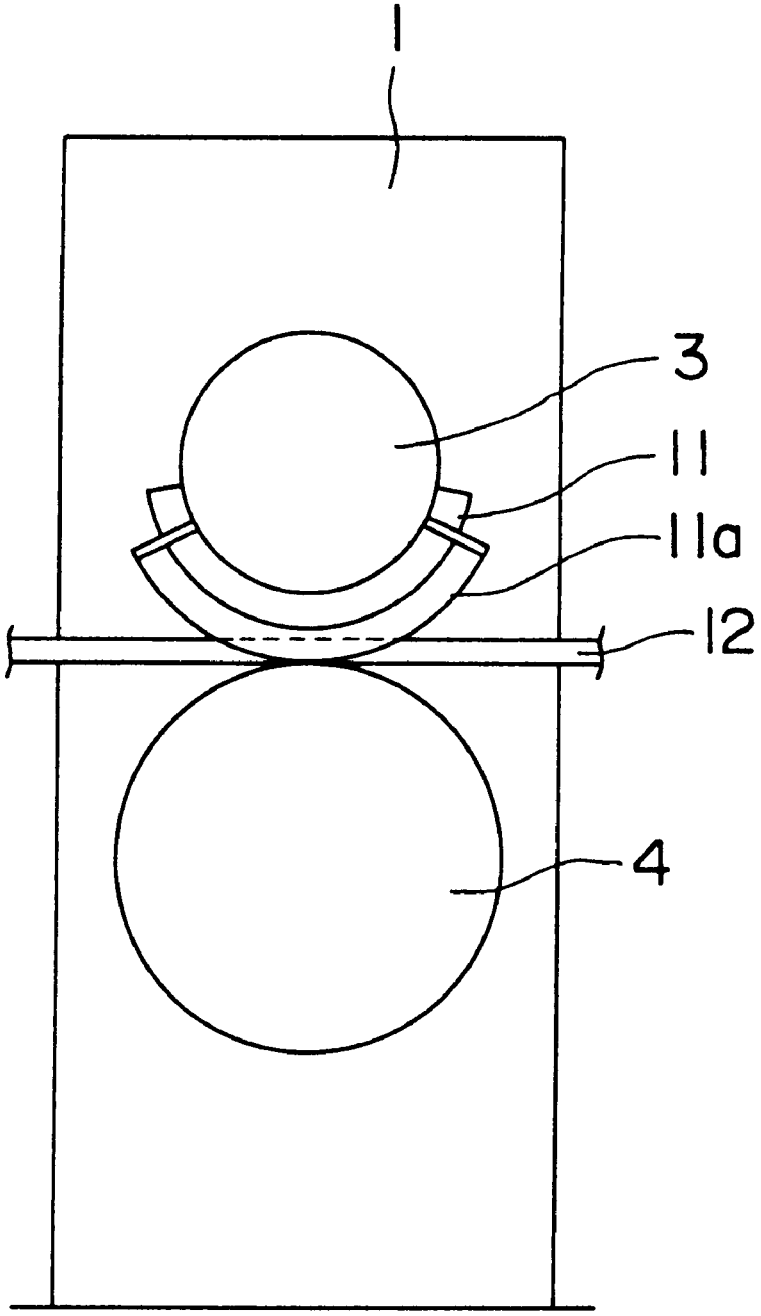
FIG. 5 (PRIOR ART)
FIG. 5 is a sectional view taken along the line A—A of FIG. 4, showing a blanking section of the rotary die cutter.
Figure 6:
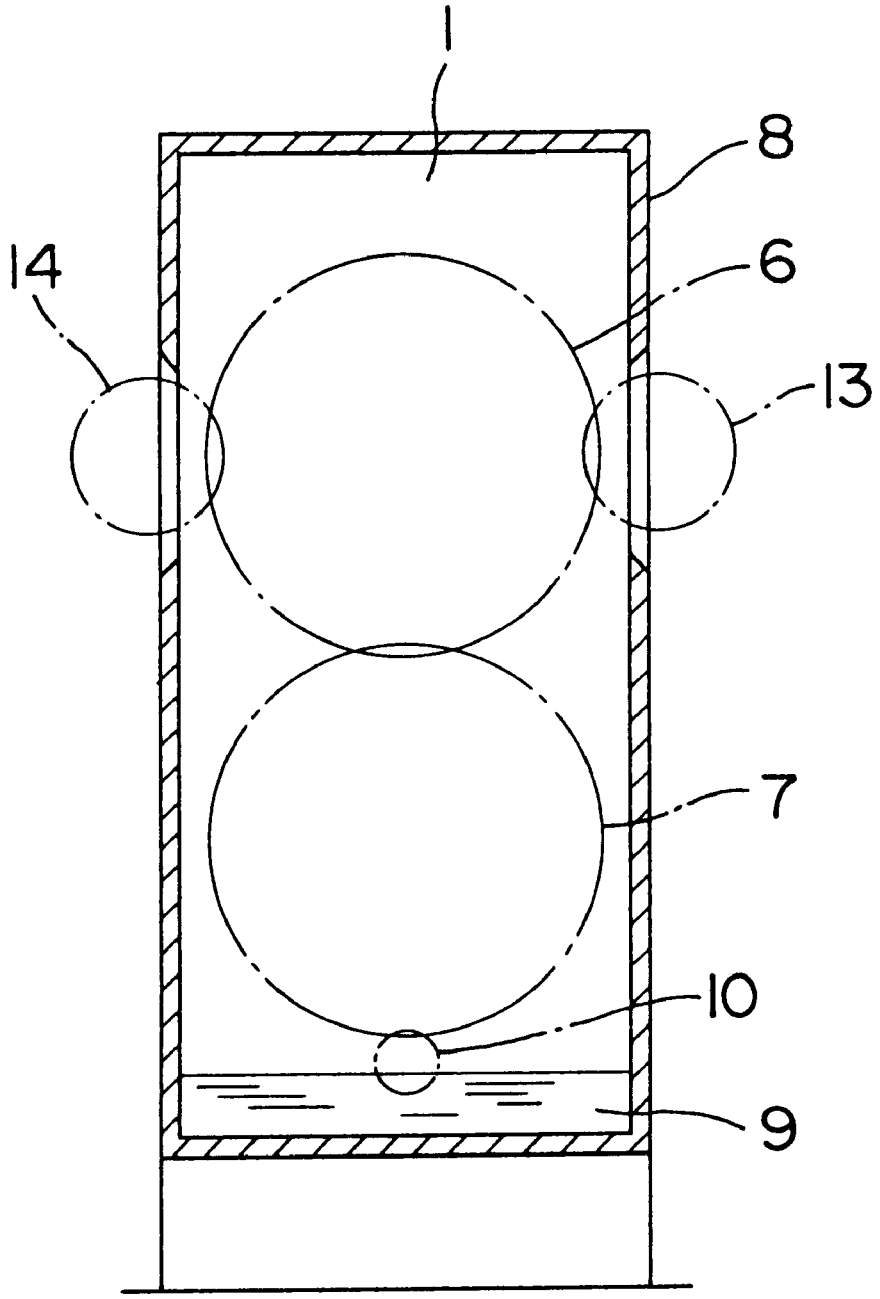
FIG. 6 (PRIOR ART)
FIG. 6 is a sectional view taken along the line B—B of FIG. 4, showing a blanking section of the rotary die cutter, in which gears are indicated by imaginary lines.

An embodiment of the present invention will be described with reference to FIG. 1. In this figure, the same reference numerals are applied to the elements common to those in the conventional rotary die cutter shown in FIGS. 4 to 6, and the explanation of those elements is omitted. The rotary die cutter shown in this embodiment, which has frames 1 rotatably supporting a die cut cylinder 20 and an anvil cylinder 21 via bearings 22, is characterized in that oil circulates in the die cut cylinder 20 and/or the anvil cylinder 21. The oil is a lubricating oil for lubricating the gears 6 and 7 for driving the die cut cylinder 20 and the anvil cylinder 21, respectively, and this lubricating oil 9 is also scattered by the gears 6 and 7 so as to splash on the frames 1.

The following is a more detailed description of the above construction. Specifically, the frames 1 are disposed on the opposite sides of the cylinders 20 and 21 so as to rotatably support the support shafts 202 of the cylinders 20 and 21 via the bearings 22. The frame 1 is provided with a side cover 8 for covering the gears 6 and 7 to seal them. The side cover 8 has an oil reservoir 8*a* for storing lubricating oil 9 at the lower portion under the gears 6 and 7 (the portion under the bearings 22). The lubricating oil 9 stored in the oil reservoir 8*a* adheres to a gear 10 supported rotatably on the frame 1, and further adheres to the gear 7 meshing with the gear 10, by which the gears 7 and 6 are lubricated.

The die cut cylinder 20 is formed so that the interior thereof is made hollow by a cylindrical member 201. Although only the die cut cylinder 20 is shown sectionally in FIG. 1, the anvil cylinder 21 also has exactly the same construction, so that the description of the anvil cylinder 21 is omitted. In the cylindrical member 201, a partition plate 23 is provided at the central portion in the axial direction, and also a supply pipe 25 is provided along the axial direction. The supply pipe is provided so as to reach the partition plate 23 from one end of the cylindrical member 201, and also provided so as to reach the partition plate 23 from the other end of the cylindrical member 201. These supply pipes 25, 25 are the same, and the construction around one end of the cylindrical member 201 is the same as that around the other end of the cylindrical member 201, so that only a half of the cylindrical member 201 from the central portion to one end will be described instead of the description of the whole construction of the rotary die cutter.

The supply pipe 25 has a collar 24 at a portion close to one end thereof, and is supported rotatably on the inside face of the support shaft 202 via a bearing 26 fitted on the outer periphery of the collar 24. The other end of the supply pipe 25 is supported rotatably on the inside face of a central hole of the partition plate 23 via a bearing 27. The support shaft 202 has a cylindrical construction, and a portion thereof on the side of one end projects from the frame 1 into the side cover 8 via a bearing 22.

One end of the supply pipe 25 projects from the support shaft 202 into the side cover 8, and is connected to a discharge opening of a pump 28 through pipes 29*a* and 29. Further, the supply pipe 25 is provided with a through hole 25*a* at a portion close to the other end (near the central portion of the cylindrical member 201), and the collar 24 is also provided with a through hole 24*a*.

The pump 28 discharges the lubricating oil 9, which is sucked by a suction pipe 29*c*, to the pipe 29. The lubricating oil 9 is supplied to the supply pipes 25 located on the upper and lower sides through the pipe 29*a* branching from the pipe 29, and also supplied to the bearings 22 located on the upper and lower sides through a pipe 29*b* branching from the pipe 29.

According to the rotary die cutter constructed as described above, when the operation is started, the temperature of the upper and lower bearings 22 rises. Part of the heat generated at this time is transmitted to the frame 1, part of it is transmitted to the cylindrical member 201 via the support shaft 202, and part of it is transmitted to the lubricating oil 9 supplied to the bearing 22. At this time, the aforementioned heat is not transmitted to the central portion of each cylinder 20, 21, that is, the central portion of the cylindrical member 201, so that this portion is held at ordinary temperature.

The heated lubricating oil 9 is supplied into the cylindrical member 201 through the through hole 25*a* of supply pipe 25 by means of the pump 28, by which the temperature of the central portion of the cylindrical member 201 is also increased. The lubricating oil 9 supplied through the through hole 25*a* flows toward one end side while the temperature thereof is decreased by the absorption of heat by the cylindrical member 201, and returns to the oil reservoir 8*a* in the side cover 8 through the hole 24*a* of the collar 24. That is to say, while the temperature of the lubricating oil 9 decreases gradually toward one end side, the whole of the cylindrical member 201, from the central portion to one end side and the other end side, can be held at a substantially uniform temperature.

When the lubricating oil 9 exits to the side of the side cover 8 through the support shaft 202 and through hole 24*a*, it cools the support shaft 202, the collar 24, and the bearing 26 from the inside. The lubricating oil 9 is heated by obtaining this heat, and returns, to the oil reservoir 8*a*. By circulating the lubricating oil 9 in this manner, the temperature difference between the central portion and the end portion of the cylindrical member 201 of each cylinder 20, 21 can be made very small. In other words, the whole of the cylindrical member 201 of each cylinder 20, 21 can be held at a substantially uniform temperature.

Part of the lubricating oil 9 discharged from the pump 28 is supplied through the pipes 29 and 29*b* to lubricate and cool the bearings 22. Also, the lubricating oil 9 stored in the oil reservoir 8*a* is supplied to the driving gears 6 and 7 by the meshing of gears via the lubricating gear 10. The lubricating oil 9 supplied to the gears 6 and 7 is scattered by the centrifugal forces of the gears 6 and 7, and comes down along, for example, the frame 1 to return to the oil reservoir 8*a*. At this time, the frame 1 is cooled by the lubricating oil 9.

Thus, under the action of cooling of the support shafts 202, bearings 22, and the frame 1 by using the lubricating oil 9, the heat generated at the bearings 22 is given to the lubricating oil 9, and this heat can be given to the cylindrical member 201 of each cylinder 20, 21 quickly by using the lubricating oil 9. In this way, the heat which increases the temperature of both ends of the cylindrical member 201 can be distributed to the whole of the cylindrical member 201, so that the cylindrical member 201 can be prevented from being warped into a concave form. Moreover, since the temperature of the frame 1 is also almost the same as that of the cylindrical member 201, even if the center distance between the cylinders 20 and 21 is changed by the temperature of the lubricating oil 9, the dimension between the cylindrical members 201 can be maintained precisely so that good cutting (blanking) work can be done. As a result, a pronounced effect is achieved that a steady cutting state can be maintained even if the machine is operated for a long period of time.

Although oil is circulated in both of the die cut cylinder and the anvil cylinder in the above-described embodiment, oil may be circulated in either of the cylinders according to the situation. Also, although there is provided no cooler for cooling the lubricating oil 9 stored in the oil reservoir 8*a*, a cooler may be provided to control the temperature of the lubricating oil 9 stored in the oil reservoir 8*a* so as to be constant. By this configuration, the change of dimension due to thermal expansion is fixed to a predetermined value, so that a more pronounced effect can be achieved in obtaining a steady cutting state for a long period of time.

Invention of a second group

Figure 2:
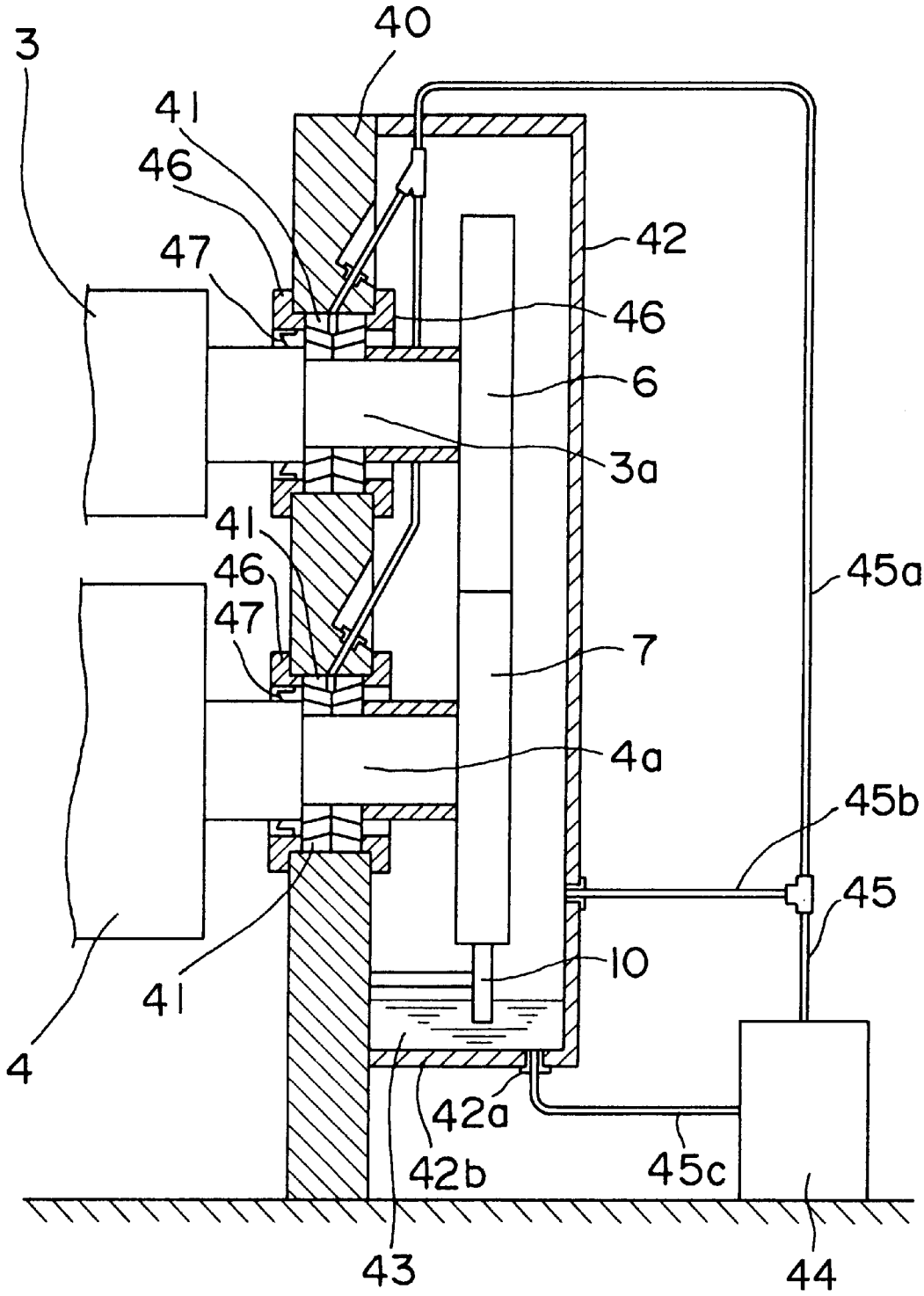
FIG. 2 is a sectional view of a principal portion of a blanking section for a rotary die cutter of a first embodiment of the invention of a second group.
Figure 3:
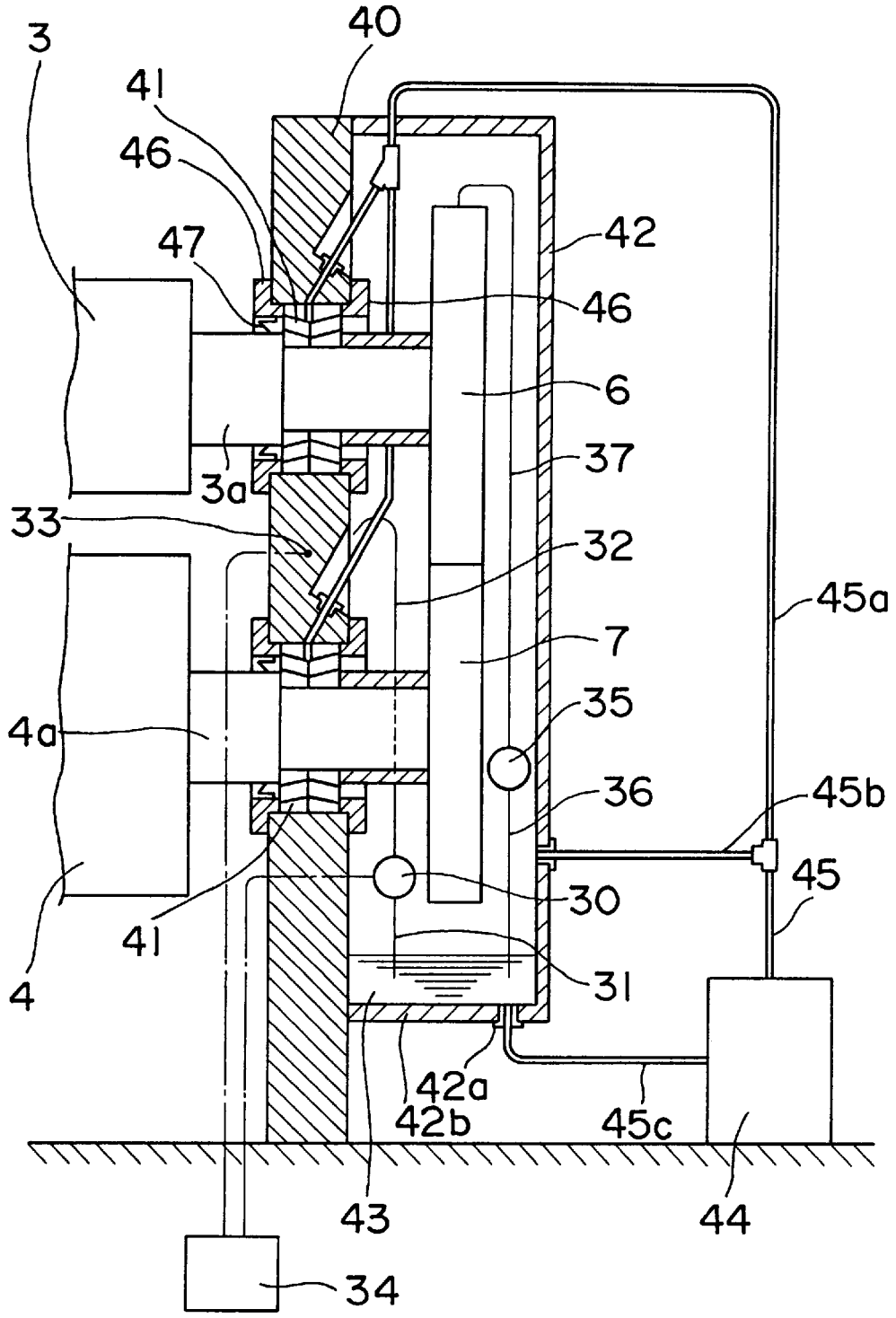
FIG. 3 is a sectional view of a principal portion of a blanking section for a rotary die cutter of a second embodiment of the invention of a second group.

Embodiments of the present invention will be described below with reference to FIGS. 2 and 3. FIG. 2 shows a first embodiment, and FIG. 3 shows a second embodiment.

First, the first embodiment will be described with reference to FIG. 2. In this embodiment, the same reference numerals are applied to the elements common to those in the conventional rotary die cutter shown in FIGS. 4 to 6, and the explanation of those elements is simplified. The rotary die cutter of this embodiment, having frames 40 for rotatably supporting a die cut cylinder 3 and an anvil cylinder 4 via a bearing 41, is characterized in that a cooled lubricating oil 43 is supplied to the bearings 41. Also, it is characterized in that the cooled lubricating oil is supplied to the frame 40. Further, it is characterized in that an oil reservoir 42*b* is provided under the bearing 41, the lubricating oil 43 stored in the oil reservoir 42*b* is cooled, and the cooled lubricating oil 43 is supplied to the frame 40 by splashing via gears 6 and 7 for driving the die cut cylinder 3 and the anvil cylinder 4, respectively.

The following is a more detailed description of the above-described configuration. The frames 40, which are disposed on the opposite end sides of the cylinders 3 and 4, rotatably supports the support shafts 3*a* and 4*a* for the cylinders 3 and 4 via the bearings 41. The frame 40 is provided with a side cover 42 for sealingly covering the surroundings of the gears 6 and 7. The side cover 42 has an oil reservoir 42*b* for storing the lubricating oil 43 at the lower portion under the gears 6 and 7 (the portion under the bearings 41). The lubricating oil 43 stored in the oil reservoir 42*b* adheres to a gear 10 supported rotatably on the frame 40, and further adheres to the gear 7 meshing with the gear 10, by which the gears 7 and 6 are lubricated.

The side cover 42 is provided with a hole 42*a* at the bottom thereof, and this hole 42*a* is connected to a cooler 44 through a pipe 45*c*. Therefore, the lubricating oil 43 in the oil reservoir 42*b* is sent to the cooler 44 successively from the bottom and cooled to an appropriate temperature (a predetermined temperature controlled by the cooler 44). Part of the cooled lubricating oil 43 is supplied to the upper and lower bearings 41 through pipes 45 and 45*a*, and part of it is bypassed to the oil reservoir 42*b* in the side cover 42 through pipes 45 and 45*b*.

The bearing 41 is fixed to the frame 40 by a bearing keep 46. A gap between the bearing keep 46 on the side opposite to the side cover 42 and the support shaft 3*a* or 4*a* is sealed by an oil seal 47, so that the lubricating oil 43 is prevented from leaking from the support shaft 3*a* or 4*a* to the outside of the frame 40. On the other hand, a gap between the baring keep 46 on the side of the side cover 42 and the support shaft 3*a* or 4*a* is open, so that the lubricating oil 43 introduced to the bearing 41 lubricates and cools the bearing 41, and is discharged to the side of the side cover 42 through the gap between the bearing keep 46 and the support shaft 3*a* or 4*a*. Further, the lubricating oil 43 comes down along the frame 40, and returns to the oil reservoir 42*b* while cooling the frame 40.

According to the rotary die cutter configured as described above, since the cooled lubricating oil 43 is supplied to the bearing 41, whereby the bearing 41 and the frame 40 are cooled, a rise in temperature of the frame 40 caused by the heat generated at the bearing 41 can be kept within a predetermined temperature. In other words, the temperature of the frame 40 can be kept constant. Therefore, the center distance between the die cut cylinder 3 and the anvil cylinder 4 can be kept constant for a long period of time, so that a steady cutting state can be kept even if the machine is operated for a long period of time.

Also, the temperature of the lubricating oil 43 is controlled to a predetermined value by the cooler 44, so that the rotary die cutter of this embodiment is very advantageous in keeping the temperature of the frame 40 constant. Therefor, from this viewpoint as well, the rotary die cutter of this embodiment is advantageous in providing steady cutting for a long period of time.

Further, the cooled lubricating oil 43 is supplied to the gears 6 and 7 via the gear 10, and the supply amount increases with the increase in rotation of the gears 6 and 7. The lubricating oil 43 supplied in larger amounts scatters to the surroundings by a centrifugal force caused by the rotation of the gears 10, 6 and 7, and comes down along the frame 40 and the inside surface of the side cover 42 to return to the oil reservoir 42*b*. That is to say, the cooled lubricating oil 43, which is stored after being bypassed through the pipe 45*b*, is supplied to the whole of the frame 40 by the pumping action and the scattering action of the gears 10, 6 and 7, so that the whole of the frame 40 can be cooled. Therefore, from this viewpoint as well, the rotary die cutter of this embodiment is advantageous in providing steady cutting for a long period of time.

In this embodiment, therefore, the aforementioned effects are exhibited comprehensively, and the temperature of the frame 40 can be kept constant for a long period of time steadily and securely. As a result, the change of the center distance between the die cut cylinder 3 and the anvil 4 can be kept at a minimum, so that very steady cutting can be provided for a long period of time.

Next, the second embodiment of the present invention will be described with reference to FIG. 3. In this embodiment, the same reference numerals are applied to the elements common to those in the first embodiment shown in FIG. 2, and the explanation of those elements is simplified. The second embodiment differs from the first embodiment in that the lubricating oil 43 is forcedly supplied to the frame 40 by using a pump 30, in that the frame 40 is provided with a temperature sensor 33, and in that the lubricating oil 43 is supplied to the gears 6 and 7 by using a pump 35 in place of the lubricating gear 10.

Specifically, the pump 30, which is provided in the side cover 42, sucks the cooled lubricating oil 43 in the oil reservoir 42*b* through a pipe 31, and delivers it to an intermediate portion between the upper and lower bearings 41, especially to the central portion between the bearings 41, through a pipe 32.

The temperature sensor 33, which consists of a thermocouple or the like, is embedded in the center in the thickness direction of the frame 40 at the intermediate portion between the upper and lower bearings 41, especially to the central portion between the bearings 41. The signal of this temperature sensor 33 is sent to a controller 34. The controller 34 controls the operation of the pump 30. Specifically, the controller 34, into which the target temperature for controlling the temperature of the frame 40 can be input, controls ON/OFF of the pump 30 so that the temperature measured by the temperature sensor 33 approaches the target temperature.

The pump 35, which is disposed in the side cover 42, sucks the cooled lubricating oil 43 in the oil reservoir 42*b* through a pipe 37, and delivers ti onto the gear 6 through a pipe 37. That is to say, the cooled lubricating oil 43 is supplied from the upside of the upper gear 6 of the vertically arranged gears 6 and 7. The pump 35 is a substitute for the lubricating gear 10 shown in the first embodiment. In the first embodiment as well, the configuration may be such that the pump 35 and pipes 36 and 37 may be provided in place of the gear 10. In this case, however, the controller 34 need not be provided.

In the rotary die cutter configured as described above, especially a portion between the bearings 41 of the frame 40 can be cooled forcedly by the cooled lubricating oil 43 discharged from the pump 30. The temperature of this portion of the frame 40 can be detected by the temperature sensor 33, and the controller 34 can calculate the difference between the preset target temperature an the temperature detected by the temperature sensor 33, and can control ON/OFF of the pump 30 so that this temperature difference falls in a predetermined range.

Specifically, the control can be carried out so that if the aforementioned temperature difference is large so that the temperature of the frame 40 is high, the pump 30 is turned on, by which the discharge amount of the lubricating oil 43 splashed on the frame 40 is increased, and if the temperature difference is small, the pump 30 is turned off, by which the discharge amount of the lubricating oil 43 splashed on the frame 40 is decreased. For this reason, especially a portion between the bearings 41 of the frame 40 can be controlled precisely within a fixed temperature range, so that the change of center distance between the die cut cylinder 3 and the anvil cylinder 4 can be kept at a minimum.

Further, since the cooled lubricating oil 43 is splashed on the gear 6 form the upside by using the pump 35, a large quantity of lubricating oil 43 with a low temperature can be scattered by the gears 6 and 7, and can be splashed on the whole of the frame 40. Therefore, the effect of cooling of the frame 40 due to the scattering of the lubricating oil 43 using the gears 6 and 7 is also improved as compared with the first embodiment.

Thereupon, steady cutting work can be done for a long period of time as compared with the first embodiment.

Although ON/OFF of the pump 30 is controlled by the controller 34 in the above-described second embodiment, the pump 30 may be controlled so that the discharge amount is changed continuously by using a variable displacement pump as the pump 30. By this configuration, the temperature of the frame 40 has a steady constant value continuously, so that an excellent effect can be achieved in performing steady cutting work.

Many other variations and modifications of the invention will be apparent to those skilled in the art without departing from the spirit and scope of the invention. The above-described embodiments are, therefore, intended to be merely exemplary, and all such variations and modifications are intended to be included within the scope of the invention as defined in the appended claims.

The disclosure of Japanese Patent Application No. 10-66505 filed on Mar. 17, 1998 including specification, claims, drawings and summary are incorporated herein by reference in its entirety.

The disclosure of Japanese Patent Application No. 10-66506 filed on Mar. 17, 1998 including specification, claims, drawings and summary are incorporated herein by reference in its entirety.

What is claimed is:

1. A rotary die cutter comprising frames, a die cut cylinder and an anvil cylinder each having opposite ends rotatably supported in the frames via a bearing, and a circulating system for circulating oil in at least one of the die cut cylinder and the anvil cylinder to reduce a temperature difference of said one of the die cut cylinder and the anvil cylinder in a width direction thereof, said one of the cylinders being hollow and having a partition plate dividing an interior of the hollow cylinder into separate portions each communicating with one of the opposite ends, said circulating system including an oil supply pipe extending through each of the opposite ends of the hollow cylinder into each of the separate portions of the interior for circulating oil in each of the separate portions, and an oil return hole in each of the opposite ends for returning oil from each of the separate portions to a reservoir in each of the frames.

2. The rotary die cutter according to claim 1, wherein the oil is also circulated in the bearing.

3. A rotary die cutter according to claim 1, further comprising a gear for driving the cylinders, the gear being disposed adjacent one of the frames, and wherein a lubricating oil for the gear is used as the oil for the circulating system, and the lubricating oil is scattered by the gear and splashed on said one of the frames to reduce a temperature difference between said one of the frames and the cylinders.

4. The rotary die cutter according to claim 1, wherein a cooler is provided to cool the oil.

5. The rotary die cutter according to claim 1, further comprising a cooler for cooling a lubricating oil that is supplied to said one of the cylinders, and a system for supplying cooled lubricating oil to at least one of the bearings.

6. The rotary die cutter according to claim 5, wherein the cooled lubricating oil is supplied to the frames.

* * * * *